US007355135B2

(12) United States Patent
Rainer et al.

(10) Patent No.: US 7,355,135 B2
(45) Date of Patent: Apr. 8, 2008

(54) SWITCH PANEL HAVING AT LEAST ONE SWITCH

(75) Inventors: Josef Rainer, Franking (AT); Erwin Bernecker, Hochburg (AT)

(73) Assignee: Bernecker + Rainer Industrie-Elektronik Gesellschaft m.b.H., Eggelsberg (AT)

( * ) Notice: Subject to any disclaimer, the term of this patent is extended or adjusted under 35 U.S.C. 154(b) by 0 days.

(21) Appl. No.: 10/579,878

(22) PCT Filed: Nov. 17, 2004

(86) PCT No.: PCT/AT2004/000403

§ 371 (c)(1),
(2), (4) Date: May 18, 2006

(87) PCT Pub. No.: WO2005/050686

PCT Pub. Date: Jun. 2, 2005

(65) Prior Publication Data

US 2007/0062794 A1 Mar. 22, 2007

(30) Foreign Application Priority Data

Nov. 20, 2003 (AT) ..... A 1862/2003

(51) Int. Cl.
*H01H 9/02* (2006.01)

(52) U.S. Cl. ..... 200/296; 200/345

(58) Field of Classification Search ..... 200/310–314, 200/341–345, 296

See application file for complete search history.

(56) References Cited

U.S. PATENT DOCUMENTS 4,225,766 A * 9/1980 Pfeifer et al. ..... 200/314
4,262,182 A * 4/1981 Basler et al. ..... 200/314
4,302,647 A * 11/1981 Kandler et al. ..... 200/512
4,967,954 A 11/1990 Von Lange
5,221,044 A 6/1993 Guins
5,520,330 A 5/1996 Brown et al.
7,105,759 B1 * 9/2006 Mucha ..... 200/310
7,119,289 B2 * 10/2006 Lacroix ..... 200/5 R (Continued)

FOREIGN PATENT DOCUMENTS

DE 32 28 290 2/1984

(Continued)

*Primary Examiner*—Michael A Friedhofer
*Assistant Examiner*—Lisa Klaus
(74) *Attorney, Agent, or Firm*—Collard & Roe, P.C.

(57) ABSTRACT

A control panel is shown with at least one switch (12) whose actuating button (6) is situated in an opening (3) of a front panel (4), and with a housing (1) arranged in the region of the opening (3) of the front panel (4) and enclosing the switch (12), which housing forms between an inner and an outer circumferential wall (2, 5) an annular gap (8) for receiving at least one lighting means (11), which annular gap is open towards the front panel (3) and is covered in a light-transmitting manner. In order to provide advantageous constructional conditions it is proposed that that the housing (1) is inserted with its outer circumferential wall (2) in a flush manner into the opening (3) of the front panel (4) and encloses the actuating button (6) with its inner circumferential wall (5), and that the light-transmitting cover of the annular gap (8) between inner and outer circumferential wall (2, 5) consists of a foil (9) extending over the front panel (4).

3 Claims, 2 Drawing Sheets

U.S. PATENT DOCUMENTS

| | | | | |
|---|---|---|---|---|
| 7,129,432 | B2 * | 10/2006 | Fujii et al. | 200/314 |
| 2005/0145468 | A1 * | 7/2005 | Kim | 200/296 |
| 2005/0194241 | A1 * | 9/2005 | Kim | 200/314 |

FOREIGN PATENT DOCUMENTS

| | | |
|---|---|---|
| DE | 296 12 738 | 10/1996 |
| DE | 297 12 888 | 11/1997 |
| GB | 944688 | 12/1963 |
| GB | 2370062 | 6/2002 |
| JP | 2085401 | 3/1990 |
| JP | 2003193402 | 7/2003 |
| WO | WO 00/74092 | 12/2000 |
| WO | WO 03/021616 | 3/2003 |

* cited by examiner

SWITCH PANEL HAVING AT LEAST ONE SWITCH

CROSS REFERENCE TO RELATED APPLICATIONS

Applicants claim priority under 35 U.S.C. §119 of Austrian Application No. A 1862/2003 filed Nov. 20, 2003. Applicants also claim priority under 35 U.S.C. §365 of PCT/AT2004/000403 filed Nov. 17, 2004. The international application under PCT article 21(2) was not published in English.

FIELD OF THE INVENTION

The invention relates to a control panel with at least one switch whose actuating button is situated in an opening of a front panel, and with a housing arranged in the region of the opening of the front panel and enclosing the switch, which housing forms between an inner and an outer circumferential wall an annular gap for receiving at least one lighting means, which annular gap is open towards the front panel and is covered in a light-transmitting manner.

DESCRIPTION OF THE PRIOR ART

In order to provide circumferential illumination in a switch of a control panel it is known from the state of the art (DE 3 228 290 A1) to form the actuating button of the switch both in a partly light-transmitting manner and to illuminate the same from the back with lighting means. When the actuating button is also situated in an opening of an opaque front panel, a circumferential illumination is obtained which is delimited from the front panel and from the opaque part of the actuating button. The disadvantageous aspect in such switches is that with a clearance of the actuating button in the actuating direction it is necessary to arrange the lighting means at a distance from the actuating button, which thus reduces the brightness of the illumination. Although this loss of brightness can be compensated by powerful lighting means, this is not appropriate for inexpensive switches. An additional factor is that the major part of the light output of the lighting means is held back by the opaque cover of the lighting button, so that without a use of light guides this output will be lost for the circumferential illumination. The use of light guides is comparatively expensive and complex from a constructional viewpoint. Moreover, such switches are susceptible to soiling of the lighting means as a result of their clearance between the actuating button and the housing, so that one must expect a continual decrease in the luminosity of the circumferential illumination. An additional factor is that as a result of the clearance it is also not possible to avoid that other switches are illuminated.

SUMMARY OF THE INVENTION

The invention is thus based on the object of improving a control panel with at least one switch of the kind mentioned above in such a way that despite the use of low-power lighting means a sufficiently bright circumferential illumination of the actuating button can be achieved without having to make a high constructional effort. Moreover, the circumferential illumination is to be comparatively inexpensive and allow for high service lives.

This object is achieved by the invention in such a way that the housing is inserted with its outer circumferential wall in a flush manner into the opening of the front panel and encloses the actuating button with its inner circumferential wall, and that the light-transmitting cover of the annular gap between inner and outer circumferential wall consists of a foil extending over the front panel.

Once the housing with the outer circumferential wall has been inserted flush into the opening of the front panel and once its inner circumferential wall encloses the actuating button, a complex constructional configuration of the actuating button can be omitted for a circumferential illumination because the annular gap lies with its lighting means separate from the switch in the opening of the front panel. No opaque cover of the actuating button is thus required as a result of the missing illumination on the back side. Moreover, sufficient brightness of the circumferential illumination can still be ensured with low-power lighting means because, on the one hand, there will not be any losses of brightness by any distances to be observed in contrast to the state of the art and, on the other hand, the entire luminosity of the lighting means can be used for the circumferential illumination. An inherently sealed receiving area is available to the lighting means with a light-transmitting cover of the annular gap by a foil extending over the front panel, as a result of which soiling can be avoided. The circumferential illumination in accordance with the invention is therefore characterized by a long service life and low costs in production and operation. A further factor is that the use of light guides can be omitted, which especially reduces the entire constructional complexity of the control panel.

When the actuating button projects with a curved actuating surface beyond the surface of the front panel then it is comparatively easy for the user to see the pressure point of the actuating button, which thus further reduces the risk of damaging the foil of the annular gap. When the actuating surface is further covered by a light-transparent protective foil extending over the housing at least in the region of the annular gap between the inner and outer circumferential wall, it is not only possible to avoid soiling of the switch, but also increasing the strength of the cover of the annular gap.

When the lighting means and the switch are provided on a printed circuit board and the same project through recesses in the floor into the housing, maintenance work can be conducted easily and rapidly by simply detaching the circuit board from the housing.

BRIEF DESCRIPTION OF THE DRAWINGS

The subject matter of the invention is shown by way of example in the drawings, wherein.

DESCRIPTION OF THE PREFERRED EMBODIMENTS

Figure 1:
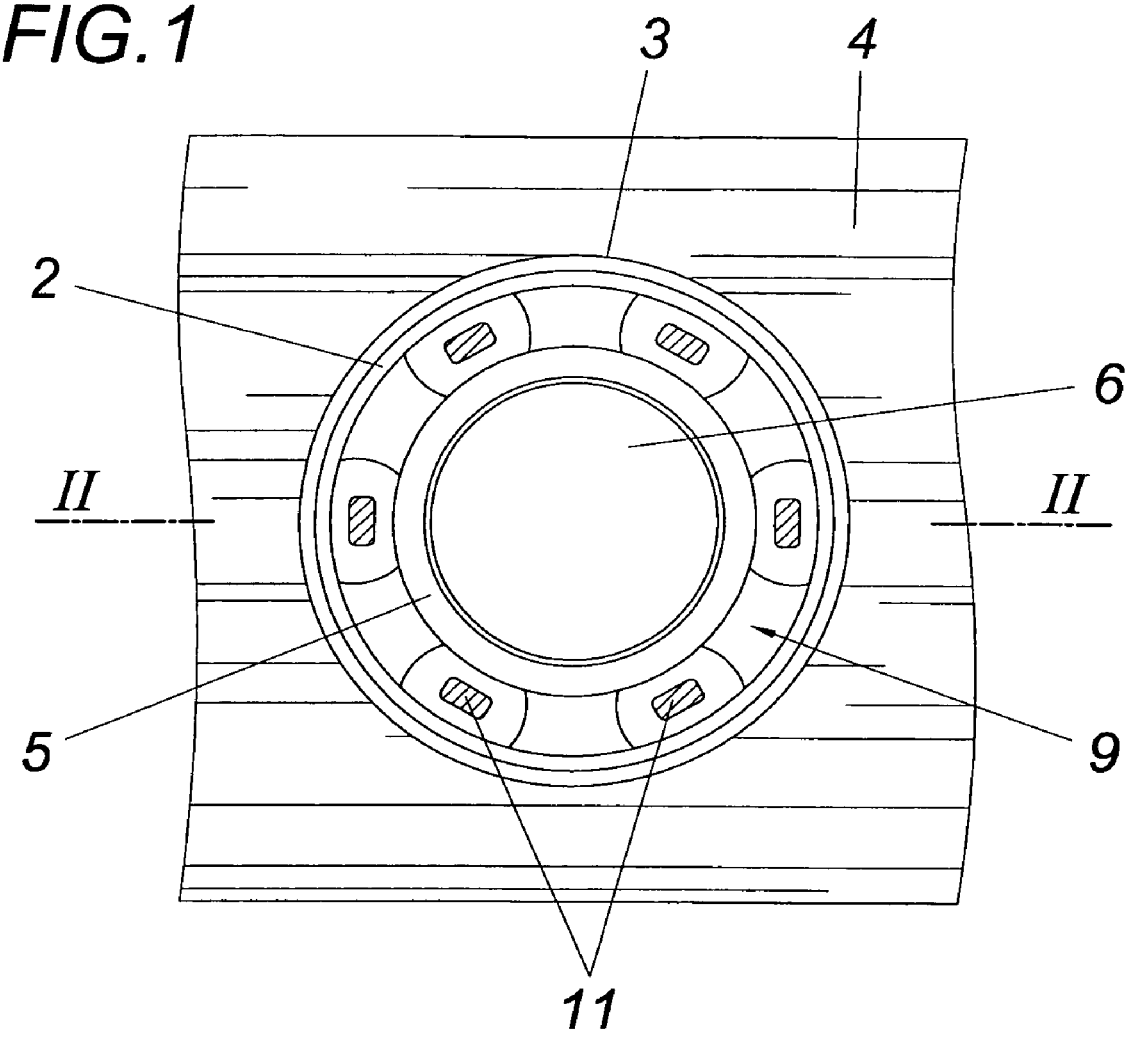
FIG. 1 shows a top view of a part of the control panel without foil cover.
Figure 2:
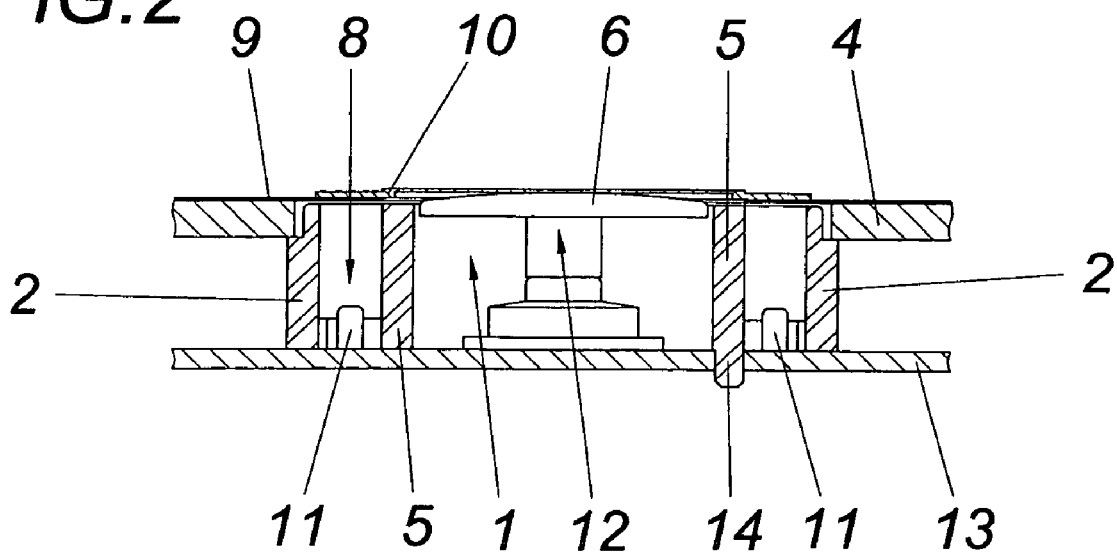
FIG. 2 shows a sectional view along II-II of FIG. 1 with the foil cover.

In the illustrated embodiment of the control panel in accordance with the invention (FIG. 1), the front panel 4, which is made of an aluminium material for example, forms an opening 3 into which a housing 1 is inserted, which housing is made of a plastic material for example. With its outer circumferential wall 2 the housing 1 is flush with opening 3 and comprises between its outer circumferential wall 2 and its inner circumferential wall 5 an annular gap 5 which is open towards the front panel 4. Several lighting means 11 are inserted in annular gap 8, which lighting means are provided for a circumferential illumination of an actuating button 6 of a switch 12 enclosed by the inner circumferential wall 5 (FIG. 2). The switching on and off of the circumferential illumination can occur for example by a control device (not shown in closer detail) which supplies electric power to the lighting means 11, e.g. LED modules, when switch 12 is activated. Switch 12 is therefore separated from the annular gap 8 by an opaque housing wall 5, as a result of which no rear illumination of the actuating button 6 is expected. A circumferential illumination with a comparatively sharp contour can be ensured since the entire luminosity of the lighting means 11 is available without any scattering losses of the circumferential illumination. In order to ensure an advantageous emission behavior of the lighting means 11 it is also possible that the sides of the housing 1 which enclose the illumination means 11 are metallized. In order to avoid soiling, the annular gap 8 is covered with a light-transmitting cover made of a foil 9 extending over the front panel 4. It has been noticed that it is advantageous to allow the foil 9 to project with its edge not only over the annular gap 8 but also up to the actuating button 6 and to optionally glue the same to the actuating button 6 in the overlapping region. Switch 12 can thus also be protected from soiling. Moreover, the narrow housing web between the annular gap 8 and the inner circumferential wall 5 can be covered.

The actuating button 6 projects with its arched actuating surface over the surface of the front panel, which also visually indicates the position of the actuating switch 6 for the user of the control panel, so that markings on the foil 9 for indicating the actuating switch 6 can be omitted. Moreover, the actuating switch 6 is covered with protective foil 10 which extends over the housing 1 and is light-transparent at least in the region of the annular gap 8 between inner and outer circumferential wall 2, as a result of which the colour of the circumferential illumination can be determined in a simple manner after the production of the control panel on the one hand and the switch 12 is protected against soiling and wear and tear on the other hand. Said additional foil cover 10 can be glued together in the overlapping region for example with the foil 9 pulled over the front panel. It is also possible that only one foil is pulled over the front panel which consists of the foil 9 and the additional foil cover 10.

Figure 3:
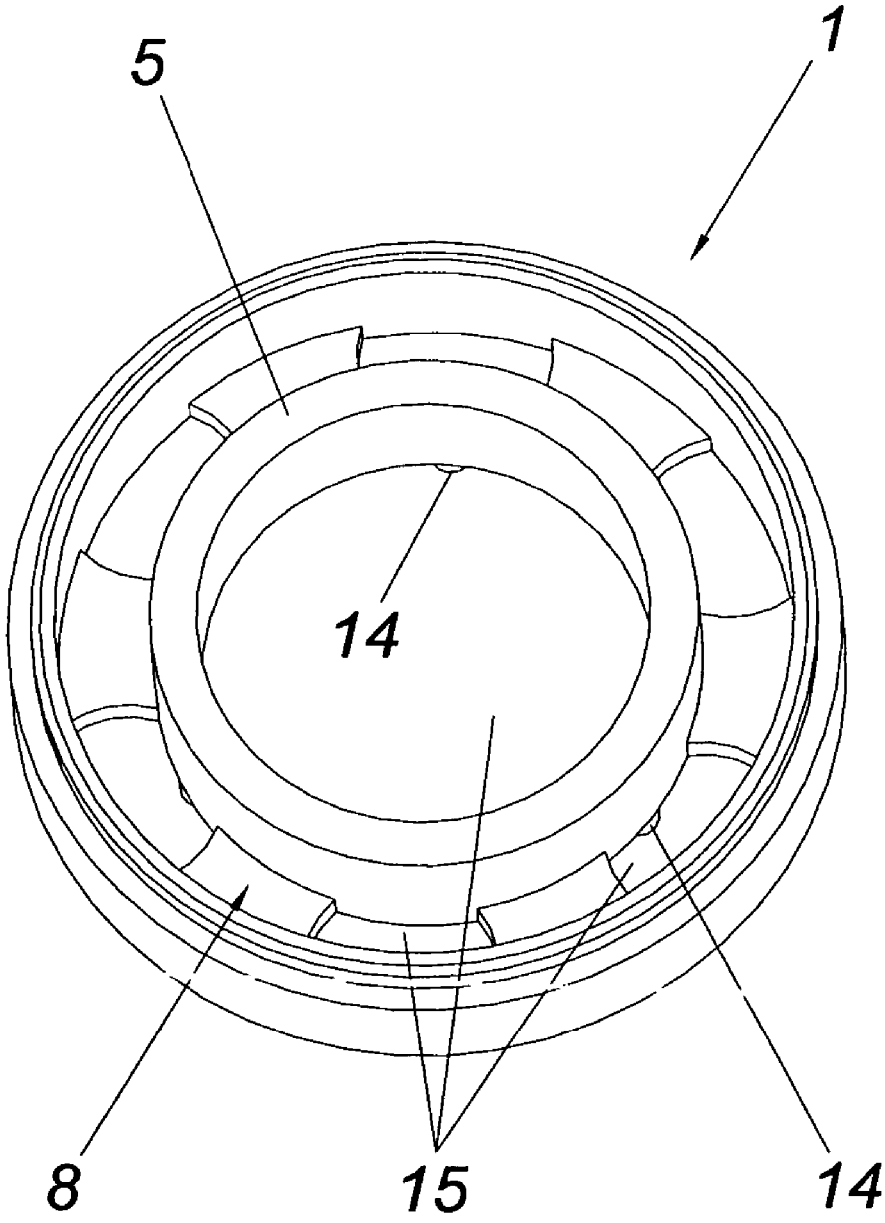
FIG. 3 shows the housing of the switch in accordance with the invention in a three-dimensional view.

The lighting means 11 and the switch 12 are provided on a printed circuit board 13 with electric connections, which circuit board 13 also comprises openings for fastening pins 14 of the housing. The printed circuit board 13 is fixedly connected to the housing 1 via said fastening pins 14, which is not shown in closer detail. In the course of maintenance work it is merely necessary to separate the printed circuit board 13 from the housing 1, as a result of which the lighting means 11 and the switch 12 are easily accessible. The housing 1 is pressed by circuit board 13 against the front panel 4 of the control panel, so that any slippage of the housing 1 can be excluded on actuating the switch 12. Recesses 15 in the floor of housing 1 are each provided (FIG. 3) for the lighting means 11 and the switch 12, into which the aforementioned project.

It is understood that the actuating button 6 and the illumination lighting are not limited to a circular shape, but that instead the circumferential illumination in accordance with the invention can be provided in any shape of the actuating button 6. It is merely necessary to adjust the annular gap 8 accordingly for this purpose.

The invention claimed is:

1. A control panel comprising:

(a) a front panel comprising an opening;

(b) a housing arranged within said opening;

(c) an annular gap formed by said housing, said annular gap being open towards said front panel and comprising an outer circumferential wall flush with said front panel and an inner circumferential wall;

(d) at least one switch having an actuating button situated within said housing and surrounded by said annular gap;

(e) at least one light source received in said annular gap; and (f) a light-transmitting cover comprising a film extending over said front panel and covering said annular gap.

2. A control panel with at least one switch whose actuating button is situated in an opening of a front panel, and with a housing arranged in a region of the opening of the front panel and enclosing the switch, which housing forms between an inner and an outer circumferential wall an annular gap for receiving at least one light source, which annular gap is open towards the front panel and is covered in a light-transmitting manner with a light-transmitting cover, wherein the housing is inserted into the opening so that the outer circumferential wall is flush with the front panel and the inner circumferential wall encloses the actuating button, and the light-transmitting cover of the annular gap comprises a film extending over the front panel, and wherein the actuating button projects with its arched actuating surface over a surface of the front panel and is covered with a protective film which extends over the housing and is light-transparent at least in the region of the annular gap.

3. A control panel with at least one switch whose actuating button is situated in an opening of a front panel, and with a housing arranged in a region of the opening of the front panel and enclosing the switch, which housing forms between an inner and an outer circumferential wall an annular gap for receiving at least one light source, which annular gap is open towards the front panel and is covered in a light-transmitting manner with a light-transmitting cover, wherein the housing is inserted into the opening so that the outer circumferential wall is flush with the front panel and the inner circumferential wall encloses the actuating button, and the light-transmitting cover of the annular gap comprises a foil extending over the front panel, and wherein the light source and the switch are provided on a printed circuit board and project into the housing through recesses in a floor of the housing.

* * * * *